United States Patent [19]

Terry

[11] Patent Number: 4,473,058

[45] Date of Patent: Sep. 25, 1984

[54] ARROW REST

[76] Inventor: Edgell R. Terry, 533 Keller Dr., New Haven, Ind. 46774

[21] Appl. No.: 429,474

[22] Filed: Sep. 30, 1982

[51] Int. Cl.[3] ..... F41B 5/00

[52] U.S. Cl. ..... 124/24 R; 124/41 A

[58] Field of Search ..... 124/41 A, 24 R, 88, 124/41 B

[56] References Cited

U.S. PATENT DOCUMENTS

| | | | |
|---|---|---|---|
| 3,342,173 | 9/1967 | Ferguson | 124/41 A X |
| 3,828,757 | 8/1974 | Finlay | 124/24 R X |
| 3,871,352 | 3/1975 | Stanislawski et al. | 124/24 R X |
| 4,215,666 | 8/1980 | Carroll et al. | 124/41 A |

*Primary Examiner*—Richard J. Apley

*Assistant Examiner*—William R. Browne

*Attorney, Agent, or Firm*—Jeffers, Irish & Hoffman

[57] ABSTRACT

A bow and arrow rest which includes a cantilever in the form of an extending free and of a wire which is pivotably mounted near the middle of a bow and movable on that pivot between an extended position to underlie and support an arrow shaft as a bow string is drawn and then released, and a retracted position so as to not interfere with passage of the rearward portion of the arrow. The cantilever is biased toward the extended position by a permanent magnet acting on the end of the wire opposite the end which supports the arrow. In a preferred form the wire is pivotably supported by an L-shaped bracket with the bracket being mounted to the bow by a bolt which also provides lateral positioning of the arrow on the arrow rest.

8 Claims, 6 Drawing Figures

ARROW REST

BACKGROUND OF THE INVENTION

The present invention relates generally to archery aids and more especially to arrow rests for attachment to archer's bows for supporting an arrow shaft during draw and release of a bowstring. More particularly, the present invention is concerned with an arrow rest which moves, as by pivoting, between an arrow shaft supporting position and a retracted position so as to not interfere with the rearward portion of an arrow as the arrow passes the rest.

With simplistic bows, the arrow rest may be simply the archer's hand gripping bow. More sophisticated bows employ flat areas sometimes in conjunction with flexible members which tend to hold an arrow shaft slidingly in a track or groove. Coil spring arrangements with free pigtail ends have also been employed as arrow rests on bows. In each case the arrow rest either maintains a fixed position or is resiliently deformable so as to move away from the arrow path as the rearward portion thereof passes. However, a significant and ever increasing force is required to deform such rests out of the arrow path.

It would be highly desirable to provide an archer's arrow rest which would provide the desired arrow shaft support yet readily move out of the arrow path so as to reduce or eliminate drag and interference with the rearward portion of the arrow as the arrow passes the rest.

SUMMARY OF THE INVENTION

Among the several objects of the present invention may be noted the achievement of the aforementioned desires and the avoidance of the aforementioned disadvantages of the prior art arrow rest schemes; the consistent positioning of arrow shafts relative to a bow at a selected location; the provision of an arrow support which exerts minimal arrow drag; the provision of an arrow support which folds out of the path of an arrow as that arrow is released in a manner to impart minimal deflection to a rearward portion of the arrow; the provision of an arrow rest which provides selectable vertical and horizontal arrow positioning and therefore also selectable windage and elevation to tailor the arrow support location to a particular bow and user; and the provision of an arrow rest which is economical, easily attached to a bow, easily adjusted, and exerts minimal drag and interference on an arrow. These, as well as other objects and advantageous features of the present invention, will be in part apparent and in part pointed out hereinafter.

In general an arrow rest or support for an archer's bow which is positionable near the middle of the bow has a rest portion movable between an extended position to underlie and support an arrow shaft as the bowstring is drawn and then released, and a retracted position so as to not interfere with passage of the rearward portion of the arrow. The rest portion is biased toward the extended position with a biasing force which decreases as the rest moves from the extended position toward the retracted position. In a preferred form the biasing is provided by a permanent magnet fixed to an L-shaped bracket which also pivotably supports the rest portion and provides for attachment of the arrow rest to the bow.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
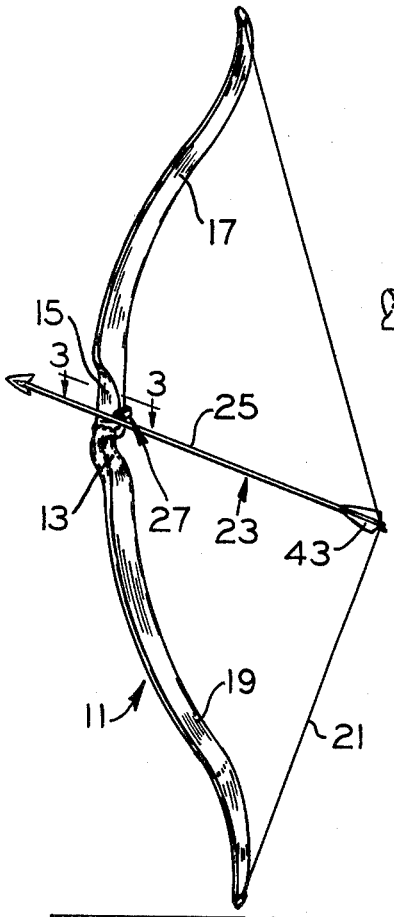
FIG. 1 is perspective view of a drawn bow and arrow with the arrow shaft resting on a support according to one form of the invention.

FIG. 1 illustrates a drawn bow 11 having a riser portion near the middle of the bow including the hand grip region 13 and the window region 15 as well as the more flexible limbs 17 and 19 toward the ends of the bow. Bowstring 21 fitting in conventional notches near the bow opposite ends engages a notch at the rear of arrow 23 and the shaft 25 of arrow 23 rests on a support near the middle of the bow in the window region 15. Thus, the bow as depicted is drawn by a user and ready for release of the bowstring and arrow.

Figure 2:
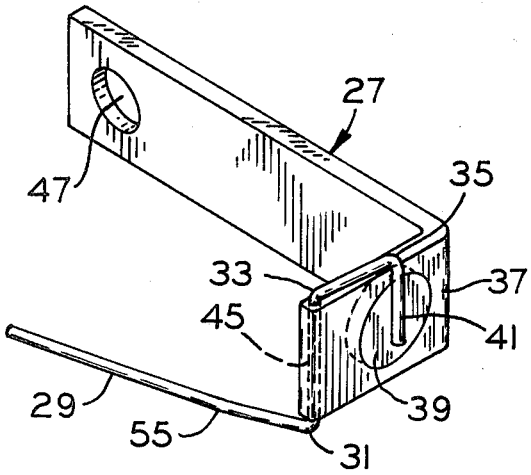
FIG. 2 is a perspective view of the support of FIG. 1.
Figure 5:
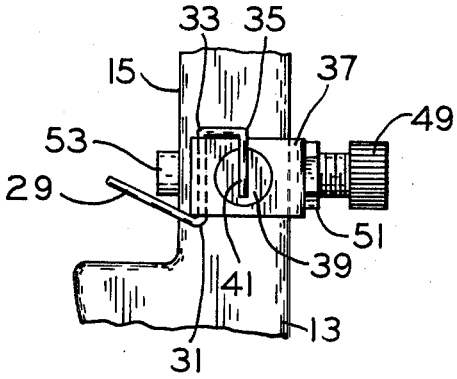
FIG. 5 is a back elevation of the support taken along line 5—5 in FIG. 3.
Figure 6:
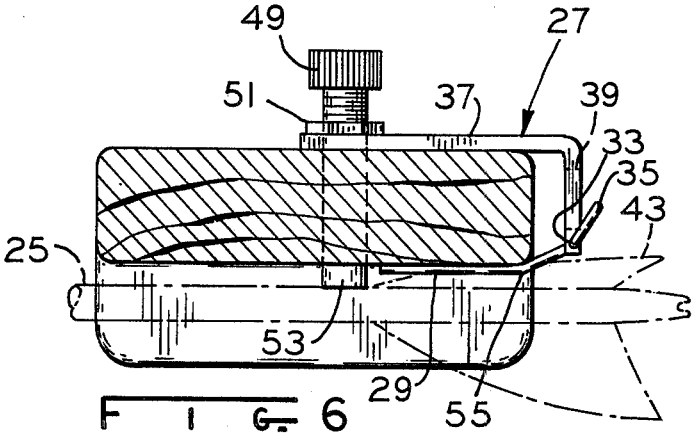
FIG. 6 is a view similar to FIG. 3 but illustrating the arrow rest portion being pushed to its retracted position by passage of the rearward portion of an arrow.

In FIG. 2, the arrow rest has an approximately 0.055 diameter wire or cantilever 29 having approximately right angle bends at 31, 33 and 35 with a portion between bends 31 and 33 passing through a hole in the L-shaped bracket 37 so that the extending beam portion 29 pivots between the position illustrated in FIG. 2 and that illustrated in FIG. 6. The portion of the wire beyond the bend 31 toward the free end of that wire of course forms the support for the arrow shaft extending from bracket 37 in a cantilever manner.

Bracket 37 includes a permanent magnet 39 and the free end 41 of wire 29 lies closely adjacent the permanent magnet 39 when the arrow support is in its extended or arrow supporting position as illustrated in FIG. 2. Positioning of the arrow shaft 25 on the support is best seen in FIG. 3.

Figure 3:
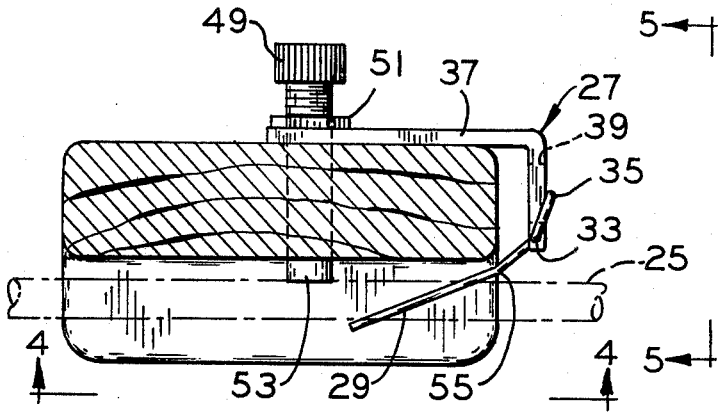
FIG. 3 is a plan view of the rest taken along line 3—3 of FIG. 1.
Figure 4:
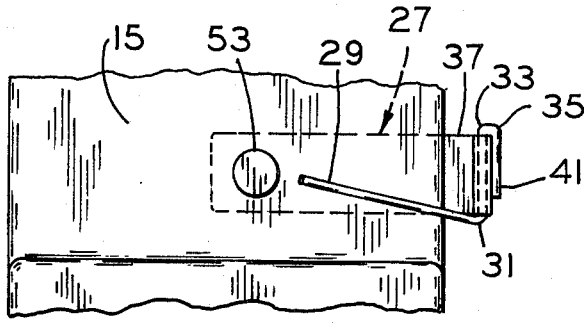
FIG. 4 is a side elevation of the support along line 4—4 of FIG. 3.

When the bowstring is released and the arrow moves forward, the rearward portion of arrow 23 such as the fletching or vane 43 of FIG. 6 lightly engages the wire causing that wire to pivot from the position illustrated in FIG. 3 to that illustrate in FIG. 6. As the wire begins this pivotal motion, wire portion 41 moves away from permanent magnet 39 and since the magnetic field of that permanent magnet 39 is approximated by the well-known Inverse Square Law, the force exerted on wire portion 41 which tends to bias the rest portion into its extended position diminishes as the rest portion moves toward its retracted position illustrated in FIG. 6. This is in contradistinction to known resilient arrow rests wherein the biasing force, if there is one, follows generally Hooks Law so that the biasing force would increase as the rest is deflected away from the arrow.

In addition to the aperture 45 for pivotably receiving the wire section between bends 31 and 33, the L-shaped bracket 37 has near the opposite end thereof aperture 47 which functions to mount the arrow rest or support on a bow. The aperture 47 receives a threaded fastener 49 which passes through the bow near the middle thereof so that the L-shaped bracket extends along one side of the bow and across the back or belly side, of the bow with the wire 29 extending along the other bow side when in its retracted position as best seen in FIG. 6. Threaded fastener 49 may be of a self-tapping variety so as to induce corresponding threads in the hole of the riser portion of the bow as it is attached or that portion may be prethreaded to receive fastener 49 or in some cases a thin nut or similar member may be provided on the arrow side of the window 15 for clamping the arrow rest securely in position. Desirably, the threaded fastener 49 includes lock nut 51 so that the extent of penetration of the free end 53 through the window portion 15 may be controlled with the free end 53 providing a rest against which arrow 25 may be positioned so as to laterally properly position the arrow shaft relative to the bow for a particular bow and a particular archer.

Vertical adjustment of the arrow rest is initially grossly determined by the location of the threaded fastener 49 in the riser portion of the bow, and after that threaded fastener is positioned, the free end of wire 29 may be bent as at 55 so that in the retracted position of the cantilever arrangement the free end of the wire lies parallel to and flat against the window portion 15 of the bow. Some additional elevation adjustment is possible by bending the free end portion of wire 29.

From the foregoing, it is now apparent that a novel arrow rest or support meeting the objects and advantageous set out hereinbefore as well as others has been disclosed and that modifications as to the precise configurations, shapes and details may be made by those having ordinary skill in the art without departing from the spirit of the invention or the scope thereof as set out by the claims which follow.

What is claimed is:

1. An arrow rest for an archer's bow comprising an L-shaped bracket having a first aperture near one end thereof and a second aperture near the opposite end thereof for mounting the arrow rest, a cantilever pivotably supported by the bracket and movable between an extended position to underlie and support an arrow shaft as a bowstring is drawn and then released and a retracted position to not interfere with passage of the rearward portion of an arrow, the bracket and cantilever forming a generally U-shaped structure adapted to upon belly sides of a bow, and magnet means on said bracket for biasing the cantilever toward the extended position, the cantilever comprising a wire having at least two approximately right angle bends therein and with a wire portion between those bends pivotably received in the first aperture, said wire having a first free end which extends away from one of said right angle bends and is for supporting an arrow shaft, said wire having an opposite free end which extends away from the other of said right angle bends and lies closely adjacent the magnet means when the free end is biased to receive an arrow and is movable away from the magnet means as the first free end moves toward the retracted position.

2. The arrow rest of claim 1 wherein the biasing force of the magnet means diminishes as the cantilever moves closer to the retracted position.

3. The arrow rest of claim 1 further comprising a threaded fastener for passing laterally through a bow near the middle thereof for fastening the arrow rest to a bow with the L-shaped bracket extending along one side and across the belly side of the bow and the cantilever extending along the window side when in the retracted position.

4. The arrow rest of claim 3 wherein the threaded fastener includes an adjustable portion extending from said window side for laterally positioning an arrow shaft.

5. A bow and arrow rest in combination comprising:

a support means connected to one side of said bow opposite the window and having a rear portion thereof extending along the belly side of said bow, said rear portion having an opening therein, a wire pivotably connected to said support means rear portion and pivotable about an axis through said opening disposed behind said bow and laterally inward from the window of said bow, said wire having one end portion thereof extending laterally along the belly side of said bow, said wire one end portion extending at least partially along said window side of said bow and said wire being movable between an extended position wherein said wire one end portion is in a rest position to support an arrow shaft and a retracted position wherein said wire one end portion lies against said bow window side, the opposite end portion of said wire being substantially flush against said end portion of said support means when said wire one end portion is in the extended position and said wire opposite end portion being spaced-apart from said support means end portion when said wire one end portion is in the retracted position, and permanent magnet means on said support means for biasing said wire one end portion toward said extended position, whereby said wire one end portion is adapted to support an arrow shaft when in said extended position, and upon release of the bowstring, the forward movement of an arrow shaft against said wire one end portion overcomes the magnet bias means and moves said wire one end portion to said retracted position substantially flush with said bow.

6. The arrow rest of claim 5 wherein said support means is removably connected to said bow, thereby permitting said arrow rest to be connected to other bows.

7. The arrow rest of claim 5 wherein said permanent magnet means is disposed on said rear portion of said support means for magnetically biasing said wire opposite end portion theretoward, thereby biasing said wire one end portion toward said extended position.

8. The arrow rest of claim 5 wherein said support means is removably connected to said bow by a threaded fastener, said threaded fastener having an adjustable remote end extending through said bow and being adapated to have an arrow shaft laterally abutting thereagainst when supported on said wire one end portion, whereby the lateral adjustment of said remote end laterally positions an arrow shaft relative to said bow.

* * * * *

UNITED STATES PATENT AND TRADEMARK OFFICE

CERTIFICATE OF CORRECTION

PATENT NO. : 4,473,058

DATED : September 25, 1984

INVENTOR(S) : Edgell R. Terry

It is certified that error appears in the above—identified patent and that said Letters Patent is hereby corrected as shown below:

On the title page:

In the Abstract, line 2, change "and" to --end--.

Col. 1, line 16, insert --the-- after "gripping".

Col. 2, line 57, change "illustrate" to --illustrated--.

Col. 3, line 37, before "set" insert --features--.

Claim 1, Col. 3, line 54, change "adapted to upon belly sides" to --adapted to span the belly side--.

Claim 5, Col. 4, line 24, after "opening" insert --, said axis being--.

Signed and Sealed this

*Second* Day of *April 1985*

[SEAL]

*Attest:*

DONALD J. QUIGG

*Attesting Officer*

*Acting Commissioner of Patents and Trademarks*